US006299834B1

(12) United States Patent
Horie et al.

(10) Patent No.: US 6,299,834 B1
(45) Date of Patent: Oct. 9, 2001

(54) HEAT-RESISTANT MAGNESIUM ALLOY

(75) Inventors: Toshio Horie; Yoshio Sugiyama; Hiroaki Iwahori, all of Aichi; Tomoyasu Kitano, Toyota; Harumi Ueno, Toyota; Takamasa Suzuki, Toyota, all of (JP)

(73) Assignee: Kabushiki Kaisha Toyota Chuo Kenkyusho, Aichi-gun (JP)

( * ) Notice: Subject to any disclaimer, the term of this patent is extended or adjusted under 35 U.S.C. 154(b) by 0 days.

(21) Appl. No.: 09/595,028

(22) Filed: Jun. 16, 2000

(30) Foreign Application Priority Data

Jun. 17, 1999 (JP) ..... 11-171227
Jun. 8, 2000 (JP) ..... 11-172198

(51) Int. Cl.[7] ..... C22C 23/00; C22C 23/04
(52) U.S. Cl. ..... 420/406; 148/420
(58) Field of Search ..... 420/406; 148/420

(56) References Cited

FOREIGN PATENT DOCUMENTS 637040 5/1950 (GB) .
1 378 281 12/1974 (GB) .
61-003863 1/1986 (JP) .
6-025791 2/1994 (JP) .
9316586 * 12/1997 (JP) .
10-513225 12/1998 (JP) .

OTHER PUBLICATIONS

Patent Abstract of Japan, JP 7–018364, Jan. 20, 1995.

Patent Abstract of Japan, JP 9–256099, Sept. 30, 1997.

* cited by examiner

*Primary Examiner*—Sikyin Ip
(74) *Attorney, Agent, or Firm*—Oblon, Spivak, McClelland, Maier & Neustadt, P.C.

(57) ABSTRACT

A heat-resistant magnesium alloy exhibiting excellent heat resistance and castability, which comprises 1.0 to 6.0 % by weight of zinc, 0.4 to 1.0 % by weight of zirconium, 1.5 to 5.0 % by weight of rare earth element, up to 0.3 % by weight of calcium, magnesium being as the balance, and unavoidable impurities.

15 Claims, 7 Drawing Sheets

Susceptibility to casting crack of Mg-2%Zn-x%Ca-2%Mm-0.6%Zr Alloy configuration of the test piece
outer diameter $\phi$15mm
inner diameter $\phi$ 7mm
length 25mm

HEAT-RESISTANT MAGNESIUM ALLOY

BACKGROUND OF THE INVENTION

1. Field of the Invention

The present invention relates to a heat-resistant magnesium alloy and, more particularly, to a heat-resistant magnesium alloy with excellent castability.

2. Description of Related Art

Recently, there has been increased need for the weight reduction of industrial materials, and as the lightweight material, magnesium alloys lighter than aluminum alloys have drawn researchers attention. Magnesium alloys are the lightest among commercial metals, and now being used as the material for automobiles as well as air planes. For example, magnesium alloys have been already used as the material for road wheels and engine head covers of automobiles.

In addition, there has been great need for the weight reduction of all automobile parts, and the application range of magnesium alloys tends to be enlarging further. For example, it has been proposed to apply magnesium alloys even to structural parts such as engine blocks or the like, and functional parts such as pistons or the like, of which the temperatures tend to be elevated. If the pistons, for example, which have conventionally been made of aluminum alloys are made of magnesium alloys, the weight thereof could be reduced, and the inertia d force or the like could be also reduced, thereby enabling weight reduction of other parts, too.

Magnesium alloy products are generally produced by casting procedure including die-casting. So, to enlarge the application range of magnesium alloys, the improvement of castability thereof is needed. Furthermore, to reduce the mass production costs, the improvement of yield rate is also needed by restraining and preventing the occurrence of casting cracks (not cracking or not tears) or any casting defects.

Under these circumstances, various kinds of magnesium alloys have been developed. Japanese Unexamined Patent Publication No. Sho 61(1986)-3863 discloses Mg—Al—Si—Mn alloys and Japanese Unexamined Patent Publication Nos. Hei 6(1994)-25791 and Hei 7(1995)-18364 disclose Mg—Zn—Ca alloys, which exhibit improved heat resistance superior to that of conventional Mg—Al—Zn—Mn alloys.

In addition, various kinds of Mg—RE—Zn alloys (RE: rare earth element(s)), which are different from the above-described alloys, have been also developed. Mg—RE—Zn alloys have been reported to exhibit good heat resistance and castability superior to those of the Mg—Zn—Ca alloys, and are disclosed in British patent publications Nos. P637040, P1378281, Japanese Unexamined Patent Publication No. Hei 9(1997)-256099 and Publication of translation of International patent application No. Hei 10-513225 (WO96/24701), etc. British patent publications Nos. P-637040 and P1378281 disclose that the addition of 0.1 to 0.9% by weight of zirconium as a grain-refining element is preferable.

Furthermore, Japanese Unexamined Patent Publication No. Hei 9(1997)-256099 discloses that 0.5 to 3% by weight of calcium can restrain the occurrence of casting cracks in the conventional Mg—Zn—Ca alloys.

Upon further investigations and researches on the magnesium alloys disclosed in Japanese Unexamined Patent Publication No. Hei 9(1997)-256099, the present inventors have clarified that in the case of magnesium alloys, when casting strain is small during casting, no crack occurs, but when casting strain becomes greater during casting, cracks may occur. The reason of the occurrence of casting strain can be considered as follows.

During casting, thermal contraction occurs due to solidification shrinkage and cooling of cast products. This thermal contraction causes the occurrence of casting strain. Provided that the cooling process is identical, the amount of casting strain depends only on the configuration of castings. For example, at corners or the like, under strong constraint, the amount of casting strain increases. However, actually, the cooling process varies from place to place due to the variation of thickness and the casting design in addition to the configuration of casting. Consequently, in low cooling rate parts, a larger casting strain may occur, and consequently cracks may occur, as compared to high cooling rate peripheral parts. Thus, casting cracks may occur in ribs, bosses and corners where the thickness greatly varies.

Publication of translation of international patent application No. Hei 10-513225 (WO96/24701) discloses that calcium operates as a castability modifier, but does not disclose any specific embodiment. This publication merely discloses that the calcium content ranges from 0 to 1% by weight. Furthermore, the present inventors have recognized that calcium makes ignition-resistant molten alloys, and consequently serves to improve the work efficiency in melting and casting operations, but may cause defects such as casting cracks, resulting in cast products being difficult to form.

Upon these investigations by the present inventors, no conventional technique of severely adjusting the calcium content to highly effect both the heat resistance and castability of Mg—RE—Zn alloys has been found yet.

SUMMARY OF THE INVENTION

It is an object of the present invention to provide heat-resistant magnesium alloys capable of exhibiting excellent heat resistance and castability of Mg—RE—Zn alloys.

To attain this object, the present inventors have earnestly researched and carried out various systematic experiments. As a result, we have found that by properly adjusting the calcium content in magnesium alloys, Mg—RE—Zn alloys capable of exhibiting improved heat resistance and castability can be obtained, and have developed heat-resistant magnesium alloys of the present invention.

The heat-resistant magnesium alloy in accordance with the present invention contains 1.0 to 6.0% by weight of zinc, 0.4 to 1.0% by weight of zirconium, 1.5 to 5.0% by weight of rare earth element(s), up to 0.3% by weight of calcium, magnesium being as the balance, and unavoidable impurities.

With the present invention, by mixing proper amounts of zinc, rare earth element(s), zirconium and calcium, both highly good heat resistance and castability of magnesium alloys can be effected, as have conventionally been difficult to be done.

Especially, by mixing a proper amount of calcium, the heat resistance can be improved, as compared to those of the conventional alloys, and by adjusting the calcium content to less than those of the conventional alloys, the casting cracks can be restrained, as compared to the conventional Mg—RE—Zn alloys.

The rare earth element(s) to be included in the heat-resistant magnesium alloy in accordance with the present invention are elements capable of improving the heat resistance due to their solid solution and crystallization and precipitation in grain boundaries. When the rare earth element (s) content is less than 1.5% by weight, the heat resistance cannot be sufficiently improved. On the other hand, when the rare earth element(s) content exceeds 5.0% by weight, the toughness deteriorates to cause the casting cracks.

To improve the heat resistance sufficiently, and ensure high toughness, the rare earth element(s) content is preferably adjusted to 1.5 to 4.0% by weight, and more preferably 2.0 to 4.0% by weight.

The rare earth element(s) include lanthanum, cerium, praseodymium, neodymium or the like. One of these rare earth element(s) or a mixture of at least two of them will do as the rare earth element(s) to be included in the heat-resistant magnesium alloy of the present invention. Furthermore, mischmetal which is a mixture of rare earth element(s) such as lanthanum, cerium, praseodymium, neodymium or the like may be used.

Zinc serves to strengthen the α-Mg phase as a based phase with its solid solution strengthening, and improve the strength of the magnesium alloy at room temperature.

When the zinc content is less than 1.0% by weight, the static strength of the magnesium alloy remarkably decreases so as to be less practical. On the other hand, when the zinc content exceeds 6.0% by weight, the amount of the solid solution of zinc increases to accelerate the diffusion, and a large amount of fusible crystalline compounds, each exhibiting low strength, crystallizes to cause the deterioration of the creep characteristics. To ensure sufficient strength at room temperature and creep characteristics, the zinc content is preferably adjusted to 1.0 to 4.0% by weight, and more preferably 2.0 to 4.0% by weight.

Zirconium is the element serving to fine grains of the magnesium alloy to improve the mechanical strength thereof.

When the zirconium content exceeds 1.0% by weight, the melting point of alloy is raised, and zirconium does not disperse homogeneously. Furthermore, the castability of the magnesium alloy is also caused to deteriorate. When the content is less than 0.4 wt %, the grain refining effect becomes low undesirably.

To prevent rising of the melting point of the magnesium alloy while ensuring fining of grains thereof, the zirconium content is preferably adjusted to 0.5 to 0.8% by weight, and more preferably 0.6 to 0.7% by weight.

Calcium is the element which is solved to a predetermined amount as a solid phase in magnesium, and serves to improve the heat resistance and proof stress of the magnesium alloy. More specifically, calcium forms fine precipitates and crystalline with magnesium. The fine precipitates enable improvement of the heat resistance, and calcium compounds crystallized in grain boundaries enable improvement of the proof stress.

When the calcium content exceeds 0.3% by weight, the casting cracks are easily caused. The reason for this has not been thoroughly investigated, but can be considered that a large amount of crystalline compounds containing calcium in grain boundaries to lower the elongation and toughness of the magnesium alloy.

Therefore, by decreasing the calcium content to 0.3% by weight or less, the heat resistance of the magnesium alloy can be improved, and the crystallization of calcium compounds, which has been regarded as the reason of occurrence of casting cracks, can be restrained to improve the castability of the magnesium alloy.

When the calcium content is 0.05% by weight or more, calcium is solved as a solid phase in a magnesium matrix to strengthen the α-Mg phase, and enables fining of precipitated particles, thus further improving the heat resistance of the magnesium alloy.

To further improve the castability and heat resistance of the heat-resistant magnesium alloy, the calcium content is preferably adjusted to 0.05 to 0.2% by weight, and more preferably 0.1 to 0.2% by weight.

Furthermore, it is preferable that the heat-resistant magnesium alloy contains 1.0 to 6.0% by weight of zinc, 0.4 to 1.0% by weight of zirconium., 1.5 to 5.0% by weight of rare earth element(s) and 0.03 to 0.3% by weight of calcium, magnesium being as the balance, and unavoidable impurities.

In this case, similarly to the above-described case, the zirconium content is preferably adjusted to 0.5 to 0.8% by weight, and more preferably 0.6 to 0.7% by weight. And the calcium content is preferably adjusted to 0.05 to 0.2% by weight, and more preferably 0.1 to 0.2% by weight. The rare earth element(s) content is preferably adjusted to 1.5 to 4.0% by weight, and more preferably 2.0 to 4.0% by weight. The zinc content is preferably adjusted to 1.0 to 4.0% by weight, and more preferably 2.0 to 4.0% by weight.

The composition range of each element has been defined in the form of x to y % by weight. This composition range, of course, includes the lower limit (x % by weight) and upper limit (y % by weight) unless otherwise defined.

The above-described "castability" can be evaluated, for example, by the existence of casting cracks when the molten alloy is cooled and solidified. In the present invention, "castability" is not limited to a specific casting method, but intended to cover other all casting methods. It is especially effective to apply the heat-resistant magnesium alloy in accordance with the present invention to the casting method of which the cooling rate is high, such as die-casting method.

The "heat resistance" can be evaluated, for example, by the mechanical characteristics (later-described fraction of bolt-load retention, creep characteristics or high temperature strength or the like) of magnesium alloys at the elevated temperatures.

Magnesium alloys have been used in not only fields of space, military and aeronautics but also other various fields such as automobiles and household electric appliances. At present, lighter, thinner, shorter and smaller products tend to be greatly demanded. So, magnesium alloys become materials necessary for the production of lightweight and compact products.

The heat-resistant magnesium alloy in accordance with the present invention does not cause any casting crack (hot cracking or hot tears) to enhance the yield rate so as to be preferably applicable to mass-produced die-cast products.

Furthermore, the heat-resistant magnesium alloy in accordance with the present invention exhibits excellent characteristics at elevated temperatures as well as normal temperature so as to be more preferably applicable to products to be used in an environment of elevated temperatures, such as engines, transmissions and their associated parts in engine compartments of automobiles.

Of course, the heat-resistant magnesium alloy in accordance with the present invention may be employed as the material for casings or the like of televisions and personal computers.

Other objects, features, and characteristics of the present invention will become apparent upon consideration of the following description and the appended claims with reference to the accompanying drawings, all of which form a part of this specification.

DETAILED DESCRIPTION OF THE PREFERRED EMBODIMENTS

To evaluate the castability and heat resistance of the heat-resistant magnesium alloy in accordance with the present invention, various test pieces of magnesium alloys with different calcium or zirconium contents were prepared, and various tests were performed. Hereinafter, the method and results of each test will be explained.

Effect of Calcium Content (1) Castability

① Test piece M1~M5

First, an inside surface of a crucible made of high chromium alloy steel (JIS: SUS430), which had been preheated in an electric furnace, was coated with magnesium chloride flux, and pure magnesium ingots were put into the crucible and melted therein. Then, zinc (Zn) and mischmetal (Mm) were added to a resulting molten metal which had been kept at 700° C. Then, the molten metal was heated to 780° C. and a Mg—Zr alloy was added thereto. A resulting molten mixture was stirred sufficiently until the added metals were completely melted, and kept at 780° C.

In this case, the composition ratio of each metal was adjusted such that the zinc content was 2.0% by weight, mischmetal content was 2.0% by weight, zirconium (Zr) content was 0.6 % by weight, magnesium being as the balance.

The mischmetal used in the above test had the composition ratio of 52.2% by weight of cerium (Ce), 25.47% by weight of lanthanum (La), 16.1% by weight of praceodium (Pr), 5.4% by weight of neodium (Nd), 0.1% by weight of samarium (Sm).

To prevent burning during the melting operation, a mixture gas of carbon dioxide gas and $SF_6$ gas was sprayed onto a surface of the molten metal in the flow rate of 0.2 L/min, and flux was dispersed on the surface of the molten metal properly.

Figure 1:
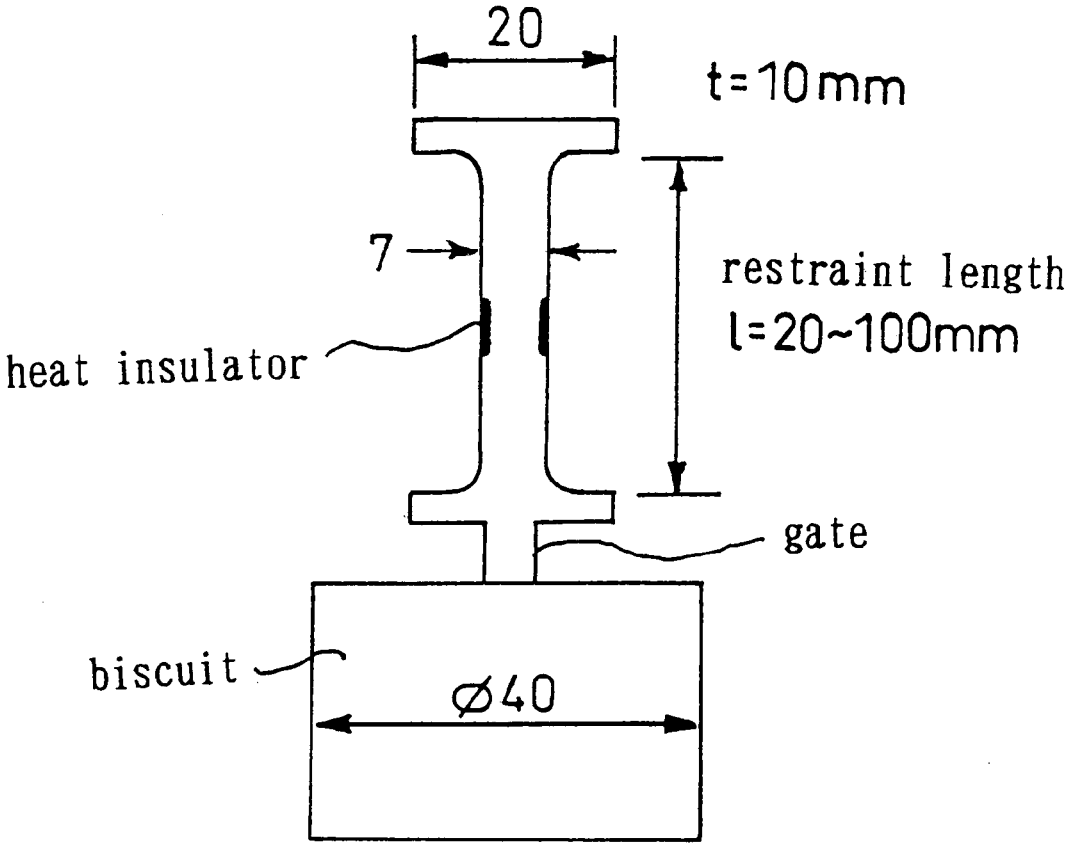
FIG. 1 is a longitudinal sectional view illustrating the configuration of a test piece employed in tests on the castability of magnesium alloys.

A thus obtained molten alloy was subjected to a die-casting to obtain test pieces M1 to M5, each having the configuration illustrated in FIG. 1. These test pieces had different restraint lengths, in order of 100 mm, 80 mm, 60 mm, 40 mm and 20 mm, as shown in TABLE 1.

The casting cracks of die-casting was confirmed by visual inspection or X-ray inspection, and was evaluated qualitatively. The evaluation results are shown together in TABLE 1 using ○ and X. ○ indicates that no casting crack was confirmed, and X indicates that casting cracks (hot casting or hot tears) were confirmed (hereinafter will be similarly indicated).

The configuration of the test piece illustrated in FIG. 1, and the production method thereof will be explained in detail.

The test piece had a columnar configuration, like a letter I. The thickness (t) thereof was 10 mm, the width of an upper side and lower side of the letter I was 20 mm, and the width of a central column part was 7 mm, respectively. The height "l" of a parallel part between the upper side and lower side of the letter I was varied to five heights, 20 mm, 40 mm, 60 mm, 80 mm and 100 mm. The height of the parallel part corresponds to the above-described restraint length.

The test pieces having the above-described five restraint lengths were produced by die-casting using a vertical casting machine provided with a die having the configuration identical to that of the test piece illustrated in FIG. 1. In this case, the dimensions of a gate was 7 mm×10 mm, the inside diameter of a cylinder was ø40 mm, the plunger speed was 0.65 m/s, the injection pressure was 64 MPa, the injection temperature was ((liquidus temperature) +20)° C., and the temperature of the die for die-casting was adjusted to room temperature (25 to 70° C.).

To correlate the restraint length with the casting strain, a heat insulator was attached to about an axial center of the parallel part of each test piece, thus concentrating the casting strain thereon. By decreasing the cooling rate intentionally in about the axial center of the parallel part to which the heat insulator is attached, casting strain in the parallel part (restraint length) was concentrated on the above-described axial center. With this arrangement, as the height of the parallel part, that is the restraint length, increased, the amount of casting strain concentrated thereon increased.

② Test piece M6~M10

Test pieces M6~M10 were obtained by further adding calcium to the magnesium alloys of the test pieces M1~M5. Namely, calcium (Ca) was added along with the above-described zinc and mischmetal such that a prepared molten alloy had the composition of 2.0% by weight of zinc, 0.17% by weight of calcium, 2.0% by weight of mischmetal, 0.6% by weight of zirconium, magnesium being as the balance.

Next, by using the resultant molten magnesium alloy, test pieces M6~M10 were produced by die-casting with the restraint length varied in order of 100 mm, 80 mm, 60 mm, 40 mm and 20 mm, similarly to the test pieces M1 to M6 The existence of casting cracks was confirmed, and the results are shown in TABLE 1.

③ Test piece M11~M13

Test pieces M11~M13 were obtained by varying the calcium content of the magnesium alloys of the test pieces M6~M10 to 0.27% by weight.

Test pieces M11~M13 were produced with the restraint length varied in order of 60 mm, 40 mm and 20 mm, similarly to the test pieces M1 to M5, and the existence of casting cracks was confirmed. The results are shown in TABLE 1.

④ Test piece M14, M15

Test pieces M14 and M15 differ from the test pieces M11~M13 only in that the calcium content is 0.31% by weight.

Test pieces M14 and M15 having the restraint lengths of 40 mm and 20 mm, respectively, were produced, similarly to the test pieces M11 to M13, and the existence of casting cracks was confirmed. The results are shown in TABLE 1.

⑤ Test piece M16, M17

Test pieces M16 and M17 differ from the test pieces M14 and M15 only in that the calcium content is 0.5% by weight.

Test pieces M16 and M17 having the restraint lengths of 40 mm and 20 mm, respectively, were produced, similarly to the test pieces M11 to M13, and the existence of casting cracks was confirmed. The results are shown in TABLE 1.

⑥ Test piece M18, M19

Test pieces M18 and M19 differ from the test pieces M16 and M17 only in that the calcium content is 0.8% by weight. Test pieces M18 and M19 having the restraint lengths of 40 mm and 20 mm, respectively, were produced, similarly to the test pieces M11 to M13, and the existence of casting cracks was confirmed. The results are shown in TABLE 1.

TABLE 1

| Test piece | Calcium (wt. %) (Mg—2% Zn—x% Ca—2% Mm—0.6% Zr) | Restraint length (mm) | Existence of casting cracks |
|---|---|---|---|
| M1 | | 100 | ○ |
| M2 | | 80 | ○ |
| M3 | 0 | 60 | ○ |
| M4 | | 40 | ○ |
| M5 | | 20 | ○ |
| M6 | | 100 | ○ |
| M7 | | 80 | ○ |
| M8 | 0.17 | 60 | ○ |
| M9 | | 40 | ○ |
| M10 | | 20 | ○ |
| M11 | | 60 | X |
| M12 | 0.27 | 40 | ○ |
| M13 | | 20 | ○ |
| M14 | 0.31 | 40 | X |
| M15 | | 20 | ○ |
| M16 | 0.5 | 40 | X |
| M17 | | 20 | ○ |
| M18 | 0.8 | 40 | X |
| M19 | | 20 | ○ |

(2) Heat resistance

① Test piece H1~H7

Figure 5:
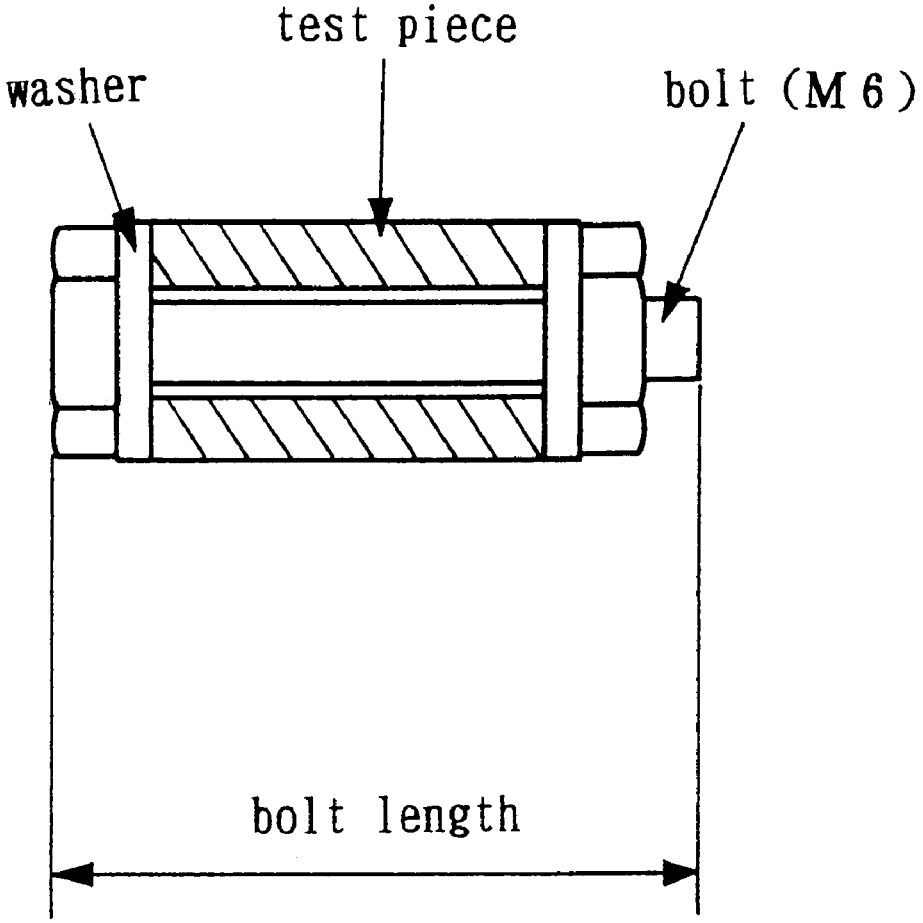
FIG. 5 is a longitudinal sectional view illustrating the configuration of a test piece employed in tests on the heat resistance, and explaining the outline of the test method.

Molten magnesium alloys which contained calcium in the amounts shown in TABLE 2 were prepared, respectively, similarly to the above-described test pieces M1 to M19, and cylindrical test pieces, each having an outside diameter of ø0 15 mm, inside diameter of ø7 mm and length of 25 mm, as illustrated in FIG. 5, were produced by die-casting, thus obtaining test pieces H1 to H7 having different calcium contents.

The existence of casting cracks in these test pieces was confirmed with visual inspection or X-ray inspection, but no casting crack was confirmed in each test piece.

These test pieces H1~H7 were tested on the heat resistance by a bolt-load retention test, which was explained in FIG. 5. In this test method, ends of each test piece were tightened with a bolt and nuts (M6) with washers (outside diameter ø: 15 mm, inside diameter: ø: 7 mm ) interposed therebetween, and the variation of bolt length was measured. Then, the fraction of bolt-load retention was calculated from the measured bolt length.

More specifically, first, the length ($L_o$) of a bolt prior to tightening was measured with a micrometer. Next, both end faces of each test piece were tightened with the bolt such that the initial surface pressure was 64 MPa. The length ($L_1$) of the bolt which was just after tightening was measured with the micrometer. And each test piece tightened with the bolt was held in the air atmosphere at 150° C. for 300 hours, and the length ($L_2$) of bolt was measured with the micrometer. Then, the fraction of bolt-load retention for each test piece was obtained from the measured bolt lengths using the following equation. The obtained fraction of bolt-load retention are shown in TABLE 2 together.

$$\text{Fraction of bolt-load retention } (\%)=(L_2-L_0)/(L_1-L_0)\times 100$$

TABLE 2

| Test piece | Calcium (wt. %) (Mg—2% Zn—x% Ca—2% Mm) | Fraction of bolt-load retention (%) |
|---|---|---|
| H1 | 0 | 70 |
| H2 | 0.02 | 74 |
| H3 | 0.04 | 79 |
| H4 | 0.08 | 87 |
| H5 | 0.09 | 84 |
| H6 | 0.20 | 85 |
| H7 | 0.38 | 91 |

Effect of Zirconium

Next, to test the effect of zirconium on the castability and heat resistance, molten magnesium alloys, each having no zirconium (Zr: 0% by weight), were prepared, similarly to the test pieces M1 to M19 and H1 to H7. The calcium content in the prepared molten magnesium alloys was varied, as shown in TABLES 3 and 4.

Test pieces, each having the configuration illustrated in FIG. 1, were produced by die-casting of these molten magnesium alloys, similarly to the above-described test pieces. Resulting test pieces M20 to M25 differ from each other in calcium content and restraint length. The existence of casting cracks in these test pieces was confirmed, similarly to the test pieces M1 to M19, and the confirmation results are shown in TABLE 3.

Test pieces, each having the configuration shown in FIG. 5, were also prepared by die-casting of these molten magnesium alloys, similarly to the above-described test pieces. Resultant test pieces H8 to H10 differ from each other in calcium content. The fractions of bolt-load retention for these test pieces were obtained, similarly to the test pieces No. H1 to H7, and the results are shown in TABLE 4.

TABLE 3

| Test piece | Calcium (wt. %) (Mg—2% Zn—x% Ca—2% Mm) | Restraint length (mm) | Existence of casting cracks |
|---|---|---|---|
| M20 | 0 | 40 | X |
| M21 | | 20 | ○ |
| M22 | 0.3 | 40 | X |
| M23 | | 20 | ○ |
| M24 | 0.5 | 40 | X |
| M25 | | 20 | ○ |

TABLE 4

| Test piece | Calcium (wt. %) (Mg—2% Zn—x% Ca—2% Mm) | Fraction of bolt-load retention (%) |
|---|---|---|
| H8 | 0 | 60 |
| H9 | 0.3 | 64 |
| H10 | 0.5 | 65 |

Evaluation (1) Test piece M1 to M19

Figure 2:
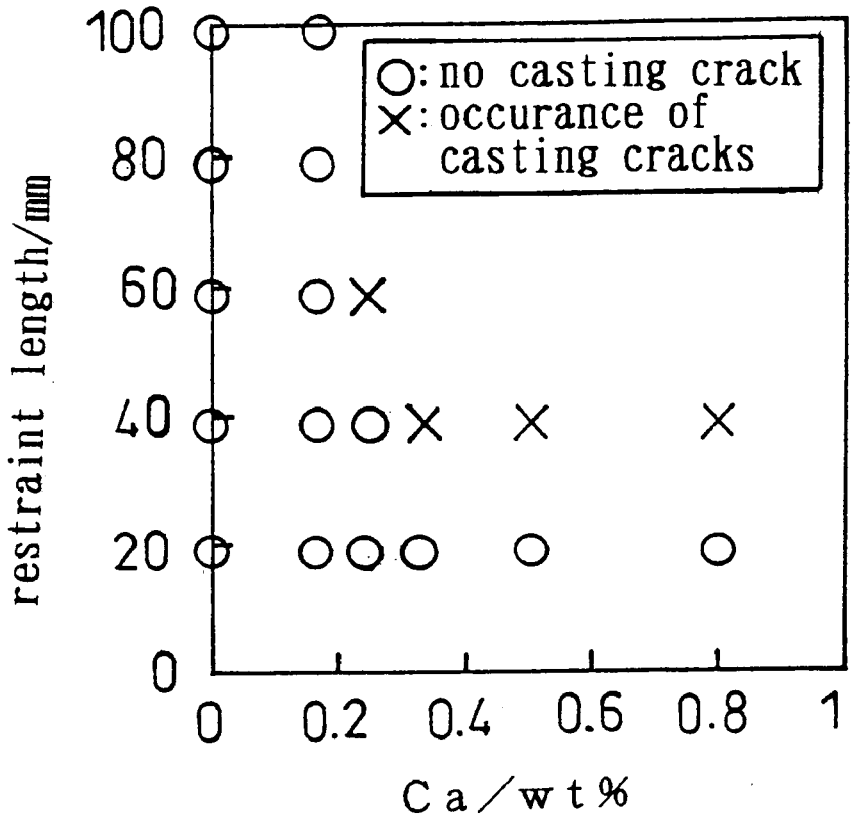
FIG. 2 is a graph showing the relationship between the difference in calcium content in magnesium alloys and restraint length, and the existence of casting cracks.

The existence of casting cracks in the test pieces listed in TABLE 1 was indicated in FIG. 2 using the symbols ○ and X. In FIG. 2, the abscissa represents the calcium content (wt. %), and the ordinate represents the restraint length (mm) of each test piece. The symbol ○ indicates that no casting crack was confirmed, and X indicates that the casting cracks were confirmed.

FIG. 2 and TABLE 1 show that in the test pieces M14 to M19, each containing more than 0.3% by weight of calcium, casting cracks occur when the restraint length exceeds 20 mm, and on the other hand, in the test pieces M1 to M13 (except for the test piece M11), each containing 0.3% by weight or less of calcium, no casting crack occurs even when the restraint length exceeds 20 mm.

From the above, it has become clear that it is very effective in preventing the casting cracks to adjust the calcium content in magnesium alloy to 0.3% by weight or less.

(2) Test pieces H1 to H7

Figure 6:
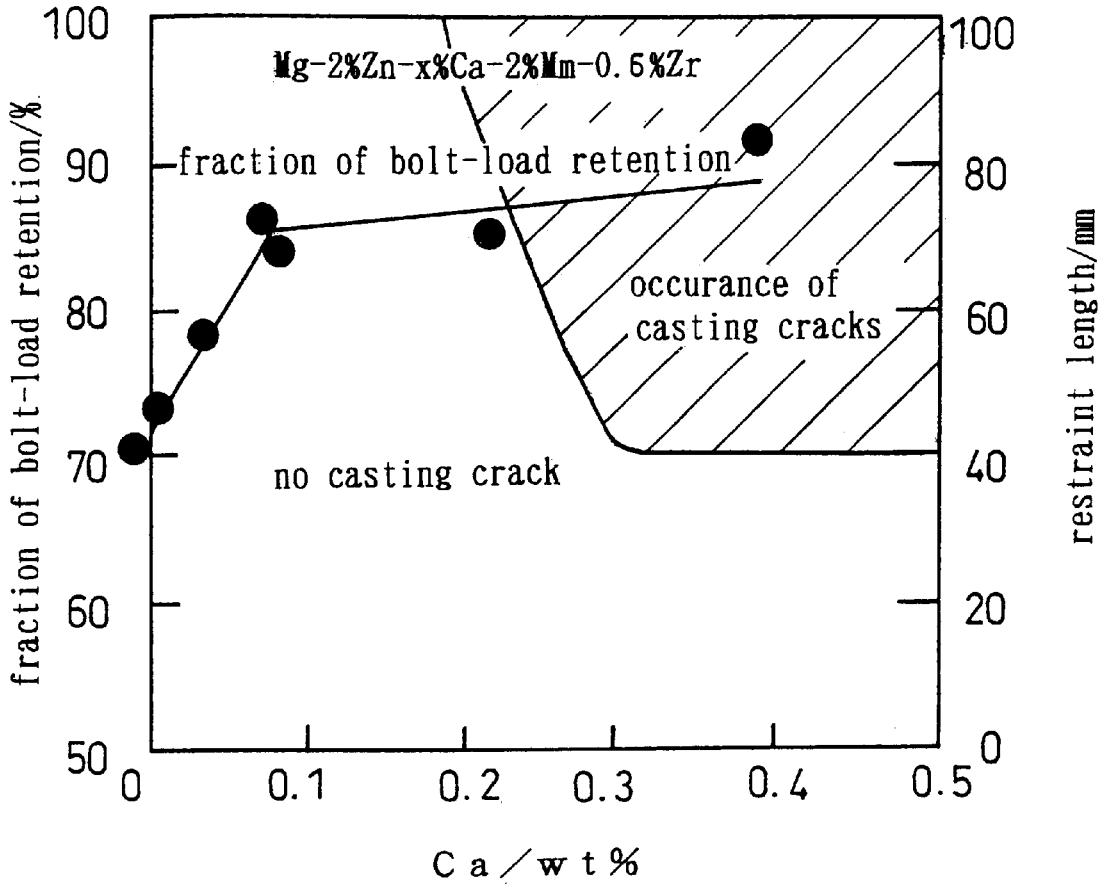
FIG. 6 is a graph showing the relationship between the calcium content in magnesium alloys and the fraction of bolt-load retention along with castability.

FIG. 6 is a graph of which the abscissa represents the calcium content (% by weight) of each test piece listed in TABLE 2, and the ordinate represents the fraction of bolt-load retention (%) of each test piece. Furthermore, FIG. 6 also shows the restraint length when casting cracks occurred in each test piece, which is obtained from FIG. 2.

From FIG. 6 and TABLE 2, it has become clear that even a small amount of calcium enables a rapid increase of fraction of bolt-load retention. As the calcium content increases from 0.03% by weight, 0.05% by weight to 1.0% by weight, the fraction of bolt-load retention increases. It has also become clear that when the calcium content exceeds about 0.1% by weight, the increasing rate of the fraction of bolt-load retention rapidly decreases.

The above results clearly show that calcium is very effective in improving the fraction of bolt-load retention, but, since the fraction of bolt-load retention becomes close to the saturated state when the calcium content exceeds about 0.1% by weight, the effective calcium content ranges from 0.1% by weight to 0.3% by weight in consideration of occurrence of casting cracks.

(3) Test pieces M20 to M25, and test pieces H8 to H10

Figure 7:
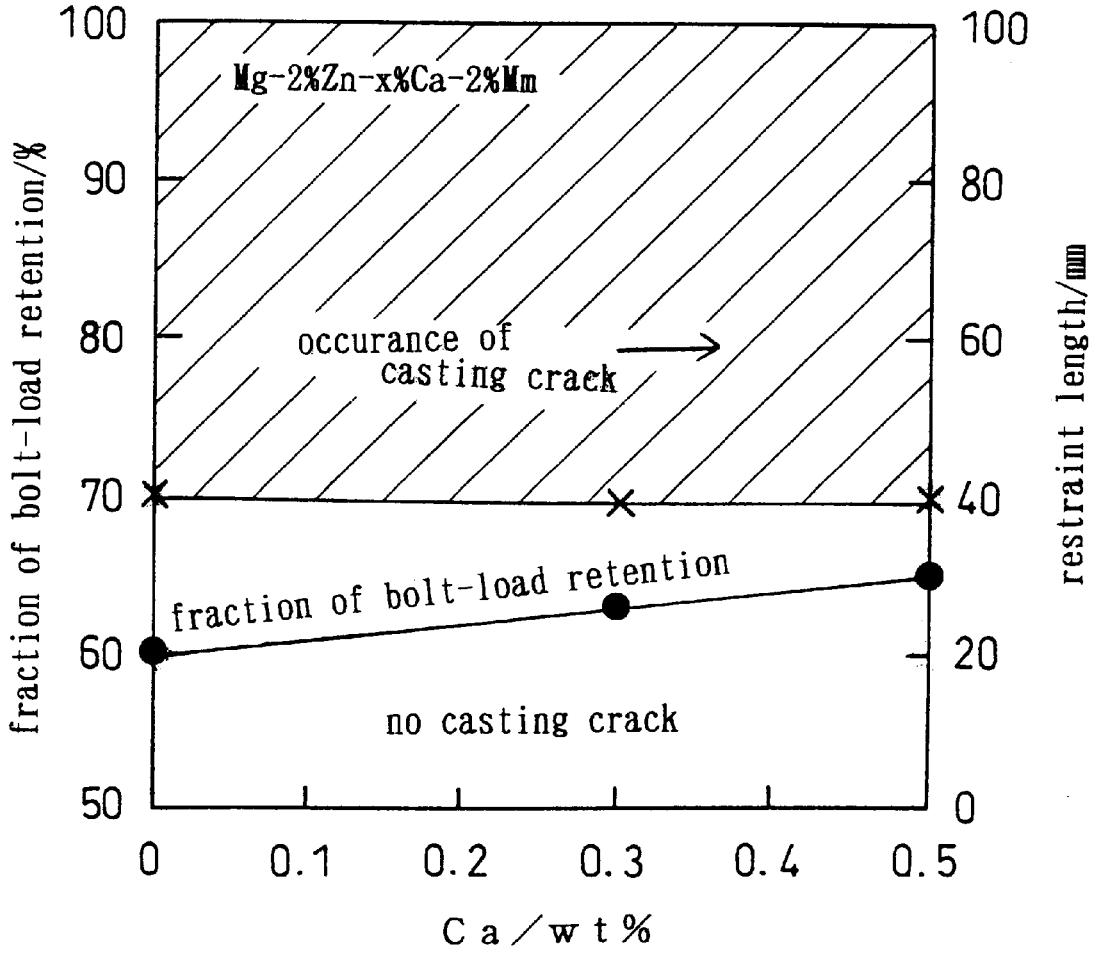
FIG. 7 is a graph showing the relationship between the calcium content in magnesium alloys which do not contain zirconium, and the fraction of bolt-load retention along with castability.

FIG. 7 is a graph showing the existence of casting cracks in each of the test pieces listed in TABLE 3. In FIG. 7, the abscissa represents the calcium content (% by weight) of each test piece, and the ordinate represents the restraint length (mm) thereof. The symbol X in FIG. 1 indicates that the casting cracks were confirmed.

FIG. 7 also shows the fraction of bolt-load retention in each of the test pieces listed in TABLE 4 by the symbol ●. In FIG. 7, the ordinate also represents the fraction of bolt-load retention (%) of each test piece.

From FIG. 7 and TABLE 3, it has become clear that in the case of the magnesium alloys which do not contain zirconium, when the restraint length exceeds 20 mm, the casting cracks occur regardless of the calcium content. And from FIG. 7 and TABLE 4, it has also become clear that in the case of the magnesium alloys which do not contain zirconium, the fraction of bolt-load retention is low, and is hardly increased even with an increase of the calcium content.

The above results clearly show that it is very important for effecting both excellent castability and heat resistance that the magnesium alloys contain zirconium in addition to a proper amount of calcium.

(4) Creep Properties

Figure 3:
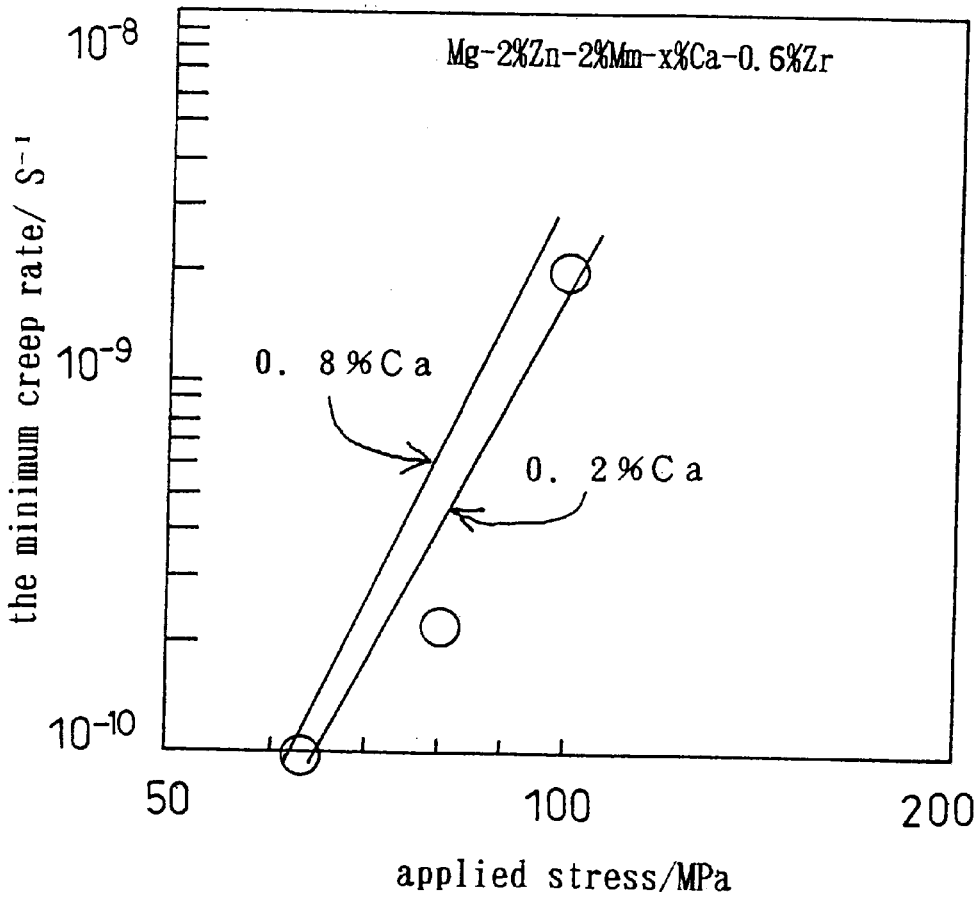
FIG. 3 is a graph showing the relationship between the calcium content in magnesium alloys and the creep characteristics.

Plates, each having a thickness of 10 mm, were produced by casting under identical conditions to those of the test pieces M6 etc., and test pieces, each having ø: 4 mm and a length of the parallel part: 20 mm, were cut out from each of the produced plates. Obtained test pieces were subjected to a tension creep test, and the test results are shown in FIG. 3. The test pieces had the composition of Mg-2% Zn-2% Mm-0.2% Ca-0.6% Zr (similar to that of the test piece M6 except that Ca content is 0.2 wt %, and indicated in FIG. 3 as "0.2% Ca") or Mg-2% Zn-2% Mm-0.8% Ca-0.6% Zr (similar to that of the test piece M18, and indicated in FIG. 3 as "0.8% Ca"). In FIG. 3, the abscissa represents the applied stress (MPa) to be applied to each test piece and the ordinate represents the minimum creep rate (1/sec.). Both the ordinate and abscissa are indicated on a logarithmic scale.

FIG. 3 clearly shows that good creep characteristics are effected even when the calcium content is as small as about 0.2% by weight.

(5) Proof stress

Figure 4:
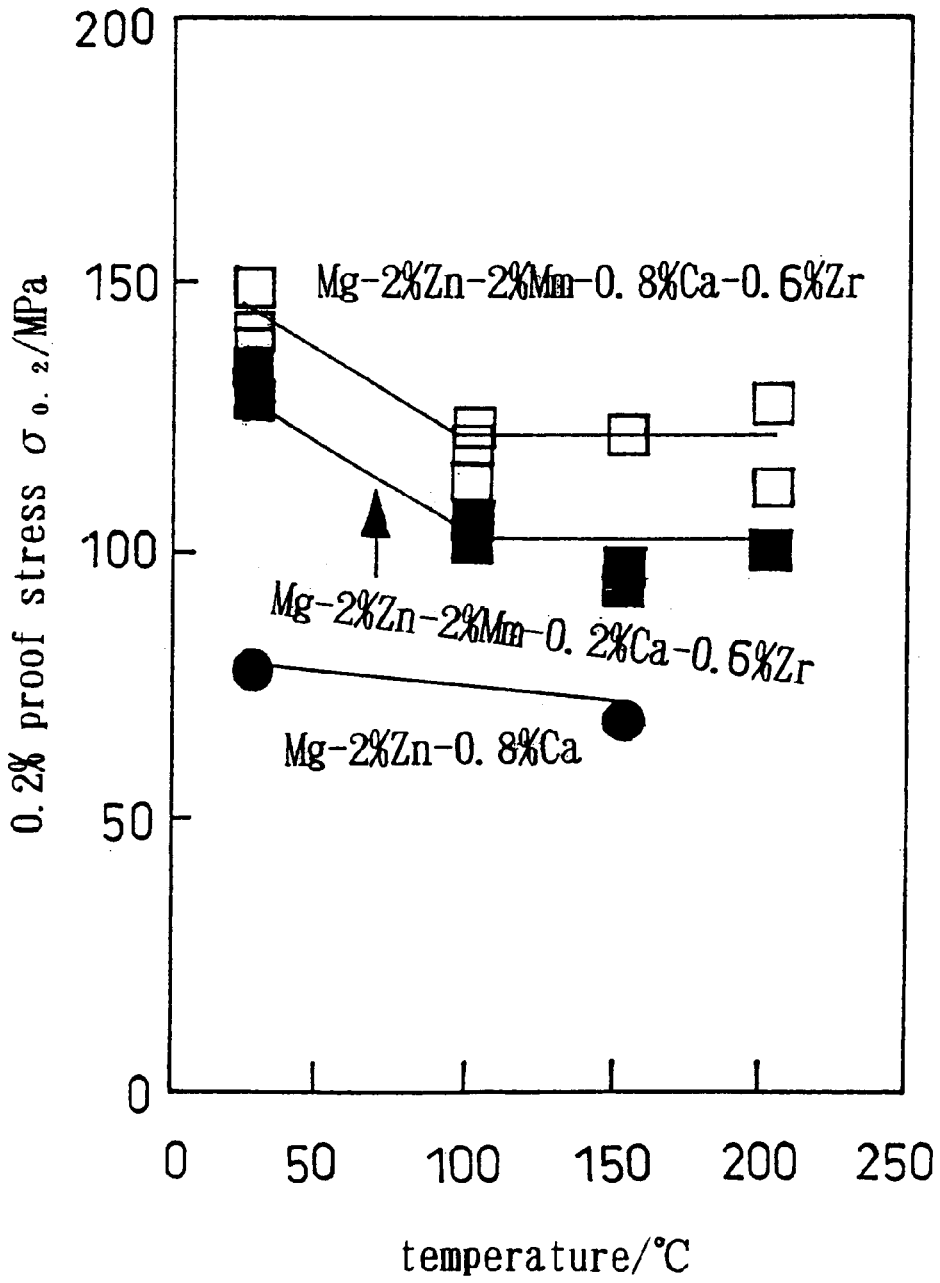
FIG. 4 is a graph showing the relationship between the proof stress and the temperature in both heat-resistant magnesium alloys in accordance with the present invention and conventional heat-resistant magnesium alloys.

Plates, each having a thickness of 10 mm, were produced by casting under identical conditions to those of the test pieces M6 etc., and test pieces, each having a rod-like configuration of a rectangular cross-section: 6 mm×3 mm and a gage length: 20 mm, were cut out from each of the produced plates. The proof stress of the obtained test pieces was measured, and the measured results are shown in FIG. 4. The test pieces had the composition of Mg-2% Zn-2% Mm-0.2% Ca-0.6% Zr ( similar to that of the test piece M6 except that Ca content is 0.2 wt %), Mg-2% Zn-2% Mm-0.8% Ca-0.6% Zr (similar to that of the test piece M18) or Mg-2% Zn-0.8% Ca (conventional heat-resistant magnesium alloy). In FIG. 4, the abscissa represents the temperature (° C.) and the ordinate represents the 0.2% proof stress (MPa) at each temperature.

FIG. 4 clearly shows that the proof stresses of the magnesium alloys, each containing a proper amount of zinc, rare earth elements and zirconium, do not greatly change with a variation of calcium content, but especially, at elevated temperatures, the proof stresses thereof are greatly improved along with the castability and creep characteristics, as compared to the conventional heat-resistant magnesium alloy.

As described above, the heat-resistant magnesium alloy in accordance with the present invention exhibits excellent castability and heat resistance, and consequently, is applicable to further enlarged technical fields.

While the invention has been described in connection with what are considered presently to be the most practical and preferred embodiments, it is to be understood that the invention is not limited to the disclosed embodiments, but, on the contrary, is intended to cover various modifications and equivalent arrangements included within the spirit and scope of the appended claims.

What is claimed is:

1. A heat-resistant magnesium alloy, consisting essentially of:

1.0 to 6.0% by weight of zinc, 0.4 to 1.0% by weight of zirconium, 1.5 to 5.0% by weight of rare earth element, up to 0.3% by weight of calcium, magnesium being the balance, and unavoidable impurities.

2. A heat-resistant magnesium alloy as claimed in claim 1, wherein the zirconium content ranges from 0.5 to 0.8% by weight.

3. A heat-resistant magnesium alloy as claimed in claim 2, wherein the zirconium content ranges from 0.6 to 0.7% by weight.

4. A heat-resistant magnesium alloy as claimed in claim 1, wherein the calcium content ranges from 0.03 to 0.3% by weight.

5. A heat-resistant magnesium alloy as claimed in claim 4, wherein the calcium content ranges from 0.05 to 0.2% by weight.

6. A heat-resistant magnesium alloy as claimed in claim 5, wherein the calcium content ranges from 0.1 to 0.2% by weight.

7. A heat-resistant magnesium alloy as claimed in claim 1, wherein the rare earth element content ranges from 1.5 to 4.0% by weight.

8. A heat-resistant magnesium alloy as claimed in claim 1, wherein the zinc content ranges from 1.0 to 4.0% by weight.

9. A heat-resistant magnesium alloy, consisting essentially of:

1.0 to 6.0% by weight of zinc, 0.4 to 1.0% by weight of zirconium, 1.5 to 5.0% by weight of rare earth element, 0.03 to 0.3% by weight of calcium, magnesium being the balance, and unavoidable impurities.

10. A heat-resistant magnesium alloy as claimed in claim 9, wherein the zirconium content ranges from 0.5 to 0.8% by weight.

11. A heat-resistant magnesium alloy as claimed in claim 9, wherein the zirconium content ranges from 0.6 to 0.7% by weight.

12. A heat-resistant magnesium alloy as claimed in claim 9, wherein the calcium content ranges from 0.05 to 0.2% by weight.

13. A heat-resistant magnesium alloy as claimed in claim 9, wherein the calcium content ranges from 0.1 to 0.2% by weight.

14. A heat-resistant magnesium alloy as claimed in claim 9, wherein the rare earth element content ranges from 1.5 to 4.0% by weight.

15. A heat-resistant magnesium alloy as claimed in claim 9, wherein the zinc content ranges from 1.0 to 4.0% by weight.

* * * * *

UNITED STATES PATENT AND TRADEMARK OFFICE

CERTIFICATE OF CORRECTION

PATENT NO. : 6,299,834 B1
DATED : October 9, 2001
INVENTOR(S) : Horie et al.

It is certified that error appears in the above-identified patent and that said Letters Patent is hereby corrected as shown below:

Title page,
Item [30], Foreign Application Priority Data should read :

-- (30) Foreign Application Priority Data

Jun. 17, 1999 (JP) ..... 11-171227
Jun. 8, 2000 (JP) ..... 2000-172198 --

Signed and Sealed this

Eleventh Day of June, 2002

*Attest:*

*Attesting Officer*

JAMES E. ROGAN
*Director of the United States Patent and Trademark Office*